US005496141A

United States Patent [19]

Popsys

[11] Patent Number: 5,496,141

[45] Date of Patent: Mar. 5, 1996

[54] ARTICLE FOR INSERTION INTO AN OPENING

[75] Inventor: Robert S. Popsys, Bicester, United Kingdom

[73] Assignee: Moss Plastic Parts Limited, Oxford, United Kingdom

[21] Appl. No.: 245,605

[22] Filed: May 20, 1994

[30] Foreign Application Priority Data

May 22, 1993 [GB] United Kingdom ..... 9310609

[51] Int. Cl.[6] ..... F16B 19/00; F16L 55/10

[52] U.S. Cl. ..... 411/510; 411/908; 411/913; 138/89

[58] Field of Search ..... 411/508, 509, 411/510, 907, 908, 913, 338, 339; 138/89, 90

[56] References Cited

U.S. PATENT DOCUMENTS

| | | | |
|---|---|---|---|
| 170,190 | 11/1875 | Pratt | 411/510 X |
| 3,272,059 | 9/1966 | Lyday et al. | 411/510 |
| 3,494,244 | 2/1970 | Wayland | 411/510 |
| 4,402,641 | 9/1983 | Arff | 411/510 |
| 4,557,653 | 12/1985 | Hill | 411/509 X |
| 5,327,942 | 7/1994 | Black | 138/89 |

FOREIGN PATENT DOCUMENTS

| | | | |
|---|---|---|---|
| 344549 | 3/1960 | Switzerland | 411/510 |
| 0520169 | 4/1940 | United Kingdom . | |
| 0982744 | 2/1965 | United Kingdom . | |
| 1266867 | 3/1972 | United Kingdom . | |
| 1551855 | 9/1979 | United Kingdom . | |

*Primary Examiner*—Neill R. Wilson

*Attorney, Agent, or Firm*—Clifford W. Browning; Woodard, Emhardt, Naughton, Moriarty & McNett

[57] ABSTRACT

An article 10 for insertion into an opening, for example for use as a closure plug in a screw-threaded hole, comprises a body 18 and two projections 22 extending outwardly from the body 18. The outer extent of the projections 22 is circular about the axis of the body 18 except for two gaps 24 which are oppositely disposed. The body 18 is tapered backwards to enable the projections 22 to fold backwards in a compact fashion so that the article can fit large and small diameter openings.

17 Claims, 3 Drawing Sheets

ARTICLE FOR INSERTION INTO AN OPENING

The invention relates to an article for insertion into an opening.

BACKGROUND OF THE INVENTION

A known article for insertion into an opening is a closure plug. The plug may be moulded from plastics material and comprises a circular cap and a narrower hollow cylindrical part extending co-axially from the cap and including a resilient circumferential rib. When the plug is pushed into an opening, the rib resiliently deforms by contact with the walls of the opening and holds the plug in place. The cap covers the end of the opening.

Such plugs may only be used for one particular size of cylindrical opening, or perhaps a small range of diameters, the limits being determined by the maximum diameter of the rib and its resilience.

SUMMARY OF THE INVENTION

According to the invention there is provided an article for insertion into an opening, the article comprising a body and a projection extending outwardly from the body for contacting a wall defining an opening, the outer extent of the projection being non-circular about the axis of the body and the part of the body which is directly behind the projection being of the same or smaller outer extent than at the root of the projection.

As the projection is non-circular about the axis of the body, a greater range of opening diameters can be accommodated, because the projection can flex further than a circular circumferential rib. Also, because the part of the body which is directly behind the projection is of the same or smaller outer extent than at the root of the projection, the projection can fold back a long way to accommodate openings which are only slighter larger than the diameter of the body.

Preferably, the part of the body which is directly behind the projection is tapered inwardly.

The shape of the outer extent of the projection may take any suitable non-circular form, and may include at least one intrusion. Indeed, preferably, the projection is non-continuous around the body. In this way, the projection can flex further than the rib of the prior plug which is continuous around the circumference of the cylindrical part. The projection may be continuous around a half or less of the circumference of the body and preferably a plurality of projections are provided around a circumference of the body. In a particularly preferred embodiment, two projections are provided. The separation between the projections is preferably small so that, in the case of an irregular aperture, there is not too large a gap between the projections to ensure that at least part of the projections will contact the wall of the opening. The gap defined between two projections may taper inwardly. Preferably, the gap defined between two projections is such that when the projections are folded back, the adjacent edges of the projections do not touch. This ensures that adjacent projections will not fold back on top of one another so that the smallest possible openings can be accommodated.

In a preferred embodiment, a further projection is provided further along the body. This will hold the article better in an opening. The further projection is preferably smaller in outer extent than the maximum outer extent of the first projection. In this way, when the first projection is folded back, in a relatively small opening, the further projection will also contact the wall of the opening to hold the article in place. The further projection may be provided behind the first projection but preferably is provided in front of the first projection. The further projection may be non-circular about the axis of the body, but preferably is circular about the axis of the body.

A cap is preferably provided on the back of the body to block off an opening into which the article has been inserted.

The body preferably includes a handle extending laterally therefrom. The handle can be used to assist in levering the article out of an opening. The handle is preferably at least as long as the diameter of the body.

Conveniently, the entire body of the article may be tapered.

BRIEF DESCRIPTION OF THE DRAWING FIGURES

Two embodiments of the invention will now be described by way of example and with reference to the accompanying drawings, in which.

DETAILED DESCRIPTION OF THE PREFERRED EMBODIMENTS

Figure 1:
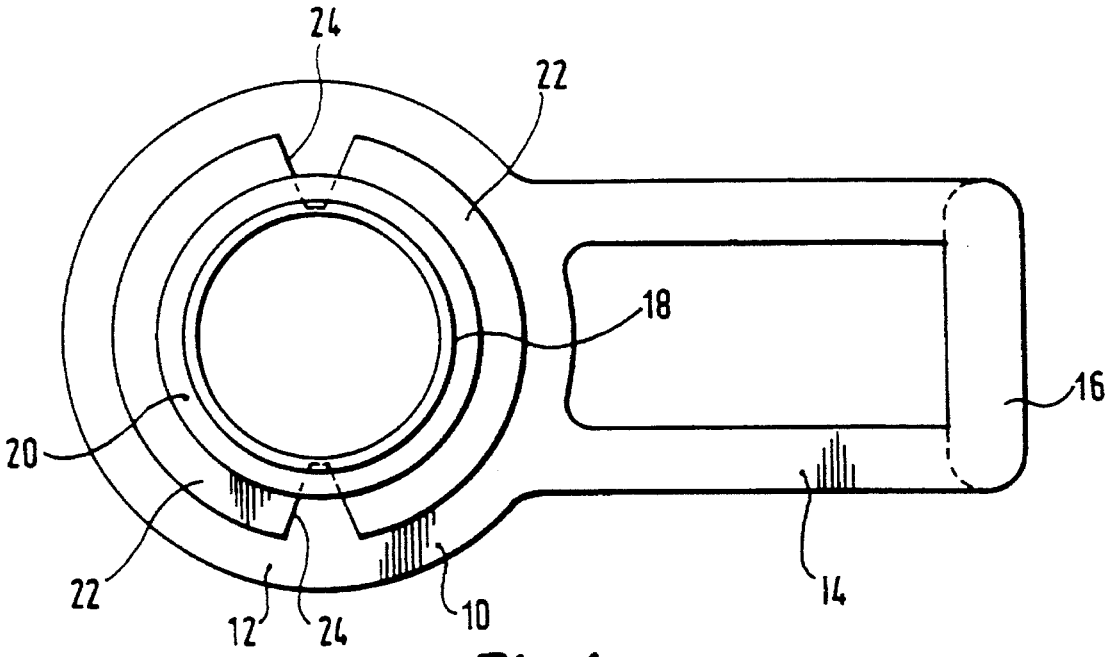
FIG. 1 is an underneath plan view of an article in one embodiment of the invention.
Figure 2:
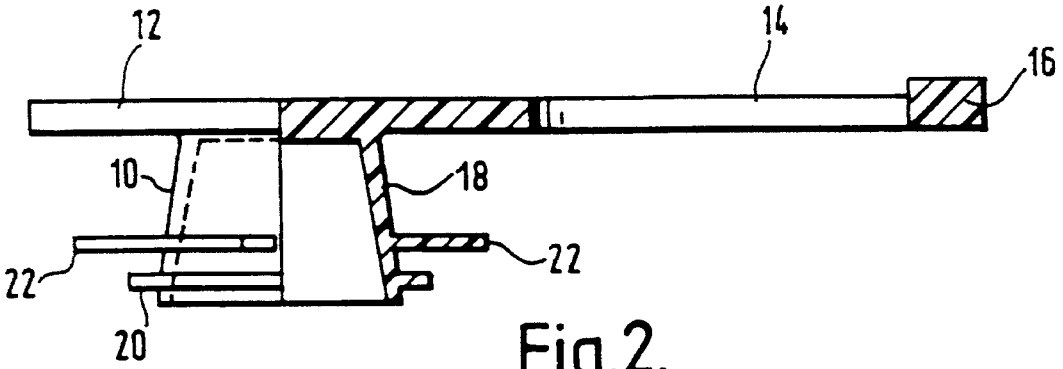
FIG. 2 is a side elevation in partial cross-section of the article of FIG. 1.

The article 10 includes a flat circular cap 12 from which two parallel arms 14 extend co-planar with the cap 12. The arms 14 are linked by a thickened connecting part 16 at their outer ends.

A broadening frusto-conical body or main part 18 extends co-axially with the circular cap 12. The angle of broadening is about 10° to the axial direction. The main part 18 is hollow. Towards the end of the main part 18 is provided a short outwardly extending circumferential rib 20. The rib 20 is continuous. About two-thirds along the length of the main part 18 from the cap 12 is provided a longer outwardly extending circumferential rib which is broken in opposite positions to form two projections or rib parts 22. The rib parts 22 are the same thickness as the smaller rib 20 but are of greater radial extent and are flexible and resilient. Each gap 24 between the rib parts 22 tapers inwardly at an angle of about 50°.

The article 10 is moulded in one piece from resilient plastics material such as low density polyethylene or TPR.

Figure 3:
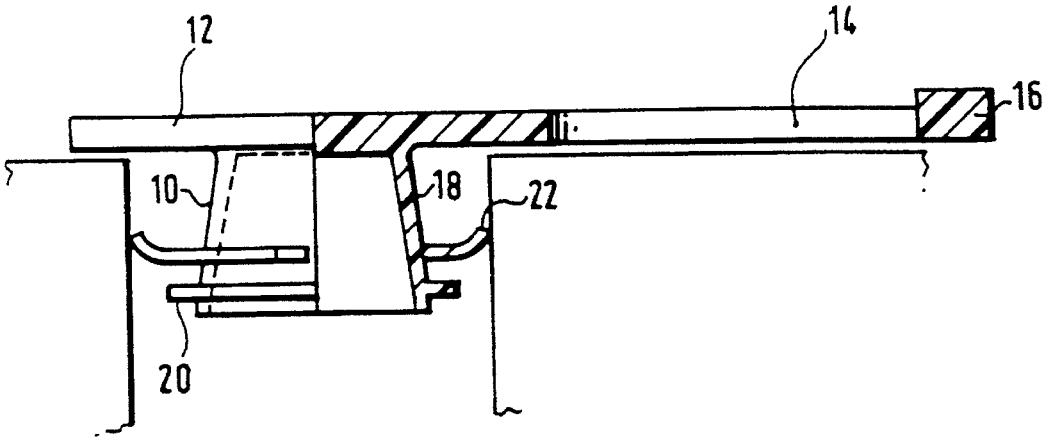
FIG. 3 is a side elevation of the article in a large opening.

FIG. 3 shows the article 10 inserted into an opening 26 with a diameter which is just smaller than the diameter of the larger rib parts 22 and larger than the smaller rib 20. Just the outer parts of the rib parts 22 are folded slightly and the resilience of the rib parts 22 holds the article in the opening. The cap 12 lies over the entrance to the opening and covers it completely.

Figure 4:
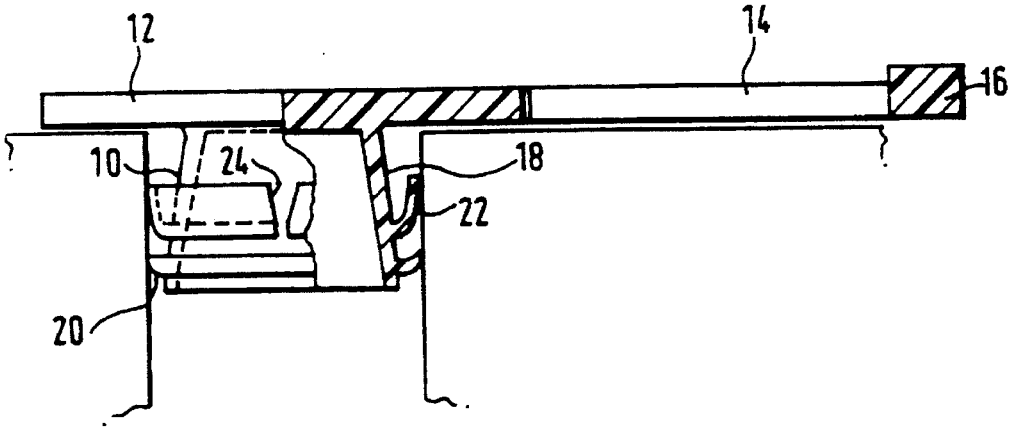
FIG. 4 is a side elevation of the article in a small opening.

FIG. 4 shows the article 10 in a smaller opening 28. This time the diameter of the opening 28 is slightly smaller than the diameter of the small rib 20 and the smaller rib 20 is slightly deformed backwards. The larger rib parts 22 have been folded back at a steep angle. The tapering of the main part 18 helps to allow this additional flexing and the fact that the gaps 24 have been provided means that the rib parts 22 can fold back while a continuous rib would have needed to fold over itself reducing flexibility. It will be seen that with the article 10 in the smaller opening 28 the angle between the edges of the rib parts 22 defining the gap 24 is smaller than 50° and in a very tight opening those edges would be almost parallel.

The article may then therefore be used in a broad range of sizes of opening. For example, the article may be sized to fit M14, M16, ½ UNF, ⅝ UNF, ¼ BSP and ⅜ BSP. The article may be sized to be usable in openings of 11 mm to 14 mm in diameter for example. The article may be used as a plug to block holes or as a cover to protect holes or for any other suitable purpose. The holes may be screw-threaded or plain.

Figure 5:
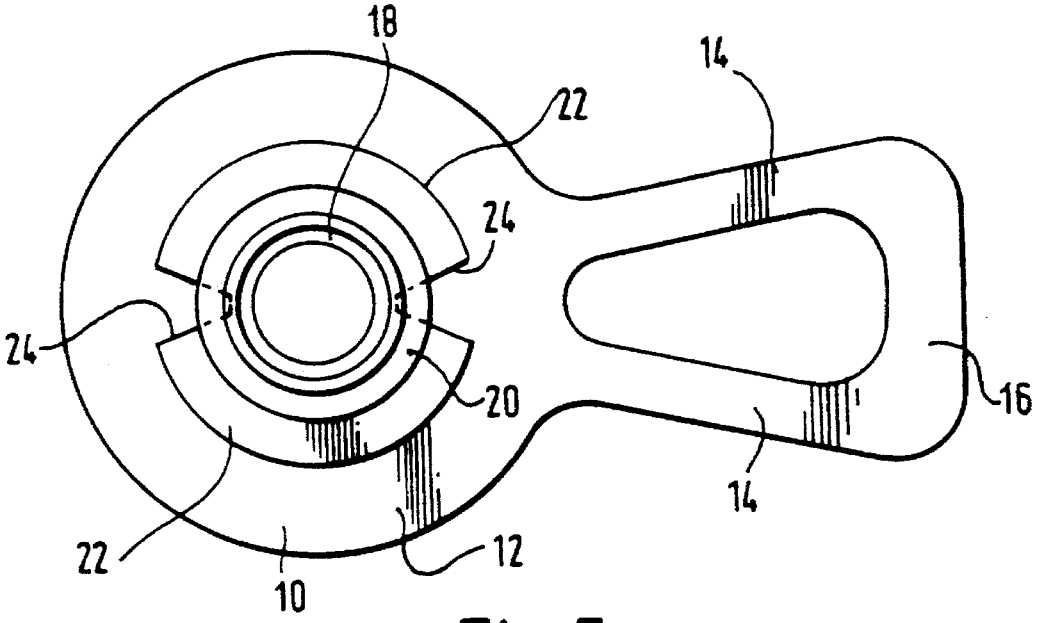
FIG. 5 is an underneath plan view of an article in a second embodiment of the invention.
Figure 6:
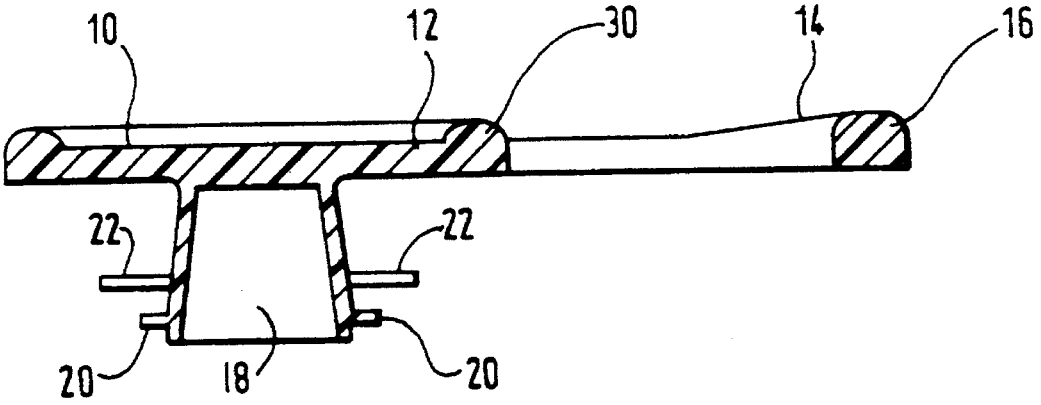
FIG. 6 is a side elevation in partial cross-section of the article of FIG. 5.

FIGS. 5 and 6 show the second embodiment which is similar to the first embodiment and the same reference numerals will be used for equivalent features. Only the differences from the first embodiment will be described.

The main constructional difference from the first embodiment in the second embodiment is the position of the gap 24 between the projections or rib parts 22. In the first embodiment, the gaps 24 face outwardly at 90° to the axis of the arms 14 of the handle. In the second embodiment, the gaps 24 face in the longitudinal direction of the axis of the handle arms 14.

The handle arms 14 in the second embodiment diverge away from the cap 12 rather than being parallel. About halfway along the arms 14, the arms start to thicken in the direction of the connecting part 16.

The cap 12 includes a rounded raised edge 30 around its upper surface.

The article 10 may be moulded in one piece from resilient plastics material such as low density polyethylene or TPR in the same way as the article 10 of the first embodiment.

I claim:

1. An article for insertion into an opening, said article comprising:

a body, the body having a front and back and defining an axis;

a plurality of projections, each projection having a root and extending outwardly from the body from the root;

the projections defining an outer extent thereof which is for contacting a wall defining the opening, and the part of the body which is directly behind the projection being tapered from the root of each projection.

2. An article as claimed in claim 1, wherein the entire body of the article is tapered.

3. An article as claimed in claim 1, wherein each projection is non-continuous around the body.

4. An article as claimed in claim 1, wherein each projection is continuous around a half or less of the circumference of the body.

5. An article as claimed in claim 1, wherein two projections are provided around a common circumference of the body.

6. An article as claimed in claim 1, wherein the separation between the projections is small.

7. An article as claimed in claim 1, wherein the gap defined between two projections tapers inwardly.

8. An article as claimed in claim 1, wherein the gap defined between two projections is such that when the projections are folded back, the adjacent edges of the projections do not touch.

9. An article as claimed in claim 1, wherein at least one first projection is provided at a different distance along the axis of the body than at least one other second projection.

10. An article as claimed in claim 9, wherein said other second projection is smaller in outer extent than the maximum outer extent of said first projection.

11. An article as claimed in claim 1, wherein a cap is provided on the back of the body to block off an opening into which the article has been inserted.

12. An article as claimed in claim 1, wherein the body includes a handle extending laterally therefrom.

13. An article as claimed in claim 12, wherein the handle is at least as long as the diameter of the body.

14. An article for insertion into an opening, said article comprising:

a body, the body having a front and back defining an axis;

a plurality of projections, each projection having a root and extending outwardly from the body from the root;

the projections being provided around a circumference of the body and extending outwardly from the body for contacting a wall defining the opening and the projections defining gaps therebetween;

the part of the body which is directly behind each projection being of the same or smaller outer extent than at the root of the projection;

the gap defined between two projections being such that, when the projections are folded back, the adjacent edges of the projections just do not touch.

15. An article as claimed in claim 14, wherein a cap is provided on the back of the body to block off an opening into which the article has been inserted.

16. An article as claimed in claim 14, wherein the body includes a handle extending laterally therefrom.

17. An article as claimed in claim 14, wherein the handle is at least as long as the diameter of the body.

* * * * *